United States Patent [19]

Küsters et al.

[11] 4,196,832

[45] Apr. 8, 1980

[54] APPARATUS FOR THE DWELL TREATMENT OF TEXTILE WEBS

[75] Inventors: Eduard Küsters, Gustav-Fünders-Weg 18, 4150 Krefeld, Fed. Rep. of Germany; Kurt Quoos, Krefeld; Johannes Kutz, St. Tönis bei Krefeld, both of Fed. Rep. of Germany

[73] Assignee: Eduard Küsters, Krefeld, Fed. Rep. of Germany

[21] Appl. No.: 903,653

[22] Filed: May 8, 1978

[30] Foreign Application Priority Data

May 10, 1977 [DE] Fed. Rep. of Germany ..... 2720941

[51] Int. Cl.[2] ..... B63H 17/42; D06B 3/00

[52] U.S. Cl. ..... 226/118; 68/158; 68/178

[58] Field of Search ..... 226/118, 119, 196, 199; 68/178, 158, 179, 177

[56] References Cited

U.S. PATENT DOCUMENTS

| | | | |
|---|---|---|---|
| 1,123,139 | 12/1914 | Palmer | 68/158 |
| 2,395,305 | 2/1946 | Vincent | 226/118 X |
| 2,804,299 | 8/1957 | Robertson | 226/199 |
| 3,990,274 | 11/1976 | Ito | 68/158 |
| 3,997,291 | 12/1976 | Fleissner | 68/178 |

*Primary Examiner*—Edward J. McCarthy
*Attorney, Agent, or Firm*—Kenyon & Kenyon

[57] ABSTRACT

In dwelling treatment apparatus for a textile web through which the web passes in a folded condition, the apparatus having a J shape with an inclined leg and lower arc, the leg is adapted for controlled inclination with respect to the vertical to control the component of force due to the weight of the folds which acts to move the web through the apparatus.

13 Claims, 1 Drawing Figure

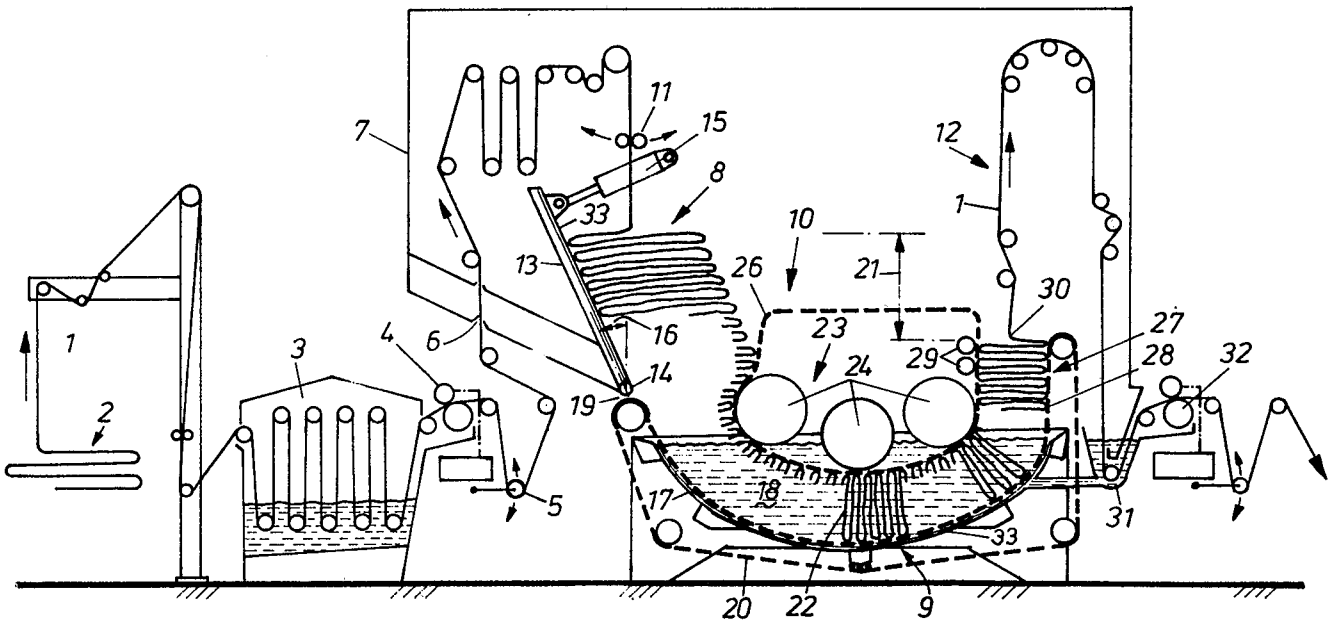
1
2
3
4
5
6
7
8
9
10
11
12
13
14
15
16
17
18
19
20
21
22
23
24
26
27
28
29
30
31
32
33

APPARATUS FOR THE DWELL TREATMENT OF TEXTILE WEBS

BACKGROUND OF THE INVENTION

This invention relates to the treatment of textile webs in general and more particularly to apparatus for a dwelling treatment of textile webs.

Apparatus for a dwelling treatment of textile webs with a storage and transport section, the vertical longitudinal cross section of which is approximately J-shaped with the long leg of the J inclined, in the travel direction of the web of material, at an angle deviating from the vertical, and above the long leg of which a folding device is arranged, by means of which the web of material can be folded or pleated from the top in substantially horizontal layers into the storage and transport section, and with a withdrawing device which is provided above the exit opening of the lower arc, is known.

A so-called J-box of the type mentioned above is described in German Offenlegungsschrift No. 19 36 111. The stack of the pleated web rests in part on a support plate which forms the inclined leg and thus takes up part of the pressure of the two to three meter high web stack, so that the lower web layers are relieved to some extent. Further, the movement of the web stack through the lower arc, caused by the pressure, is influenced.

The transport behavior of the web of material differs, depending on the kind and pre-treatment of the goods as well as on whether the lower arc is filled with a treatment liquid or not.

SUMMARY OF THE INVENTION

It is an object of the present invention to design apparatus of the afore-mentioned type in such a manner that improved control of the transport behavior is possible. According to the present invention, the angle of inclination of the leg can be varied for solving this problem.

This permits influencing the component of the weight of the web stack directed against the support plate, whereby, in turn, the remaining component acting on the feed through the lower arc can be controlled as a function of the material and the mode of operation.

The invention can be implemented by hinging the support plate, which forms the leg, about a transversal axis in the vicinity of the transition to the lower arc and by making its angle of inclination adjustable by a controllable tilting device.

The tilting device can be formed, for instance, by an arrangement of cylinders or threaded spindles engaging the support plate.

One important embodiment of the invention includes providing, in the lower arc, an endless belt arrangement which revolves in the travel direction of the web of material on a support arrangement following the shape of the arc.

This can be significant, especially in conjunction with the adjustable inclination of the support plate and thereby, the transport pressure, for turning over the web stack without trouble, inasmuch as the additional transport force acting at the lower arc is no longer left to the web itself, but an active engagement with the web takes place. The belt arrangement can be provided by one continuous belt or several belts side by side, and may, for instance, comprise screen belts. The belt arrangement may be conducted over a support floor and rest on the latter. However, it is also possible for the belt arrangement to be self-supporting and to support the web of material in the region of the lower arc; it can be conducted, for instance, in lateral guides or on rolls arranged according to the shape of the arc.

One practical arrangement comprises providing a passage between the support surface and the lower arc. The belt arrangement then runs through the passage onto the support arrangement from the outside.

Particularly in apparatus where the lower arc is formed by a tray filled with a treatment liquid, in which apparatus some goods show a tendency of floating in this region, which can upset the stack, it is advisable to provide a co-revolving hold down device at a distance above the lower arc.

Such a hold down device should run at a lower speed than the belt arrangement. This insures that points of the hold down device and the belt arrangement which are initially opposite each other at a layer of the web of material, remain approximately on the same revolving radial vector with respect to the center of the lower arc or continue to move with the same angular velocity, whereby a particularly neat guidance of the web stack can be achieved. It has been found that the stack of material traversing the upright position of the individual layers can be moved and turned through the lower arc without slippage.

The hold down device can comprise at least one roller rotating about a transversal axis or, alternatively, a belt arrangement guided in accordance with the shape of the lower arc.

In order to permit a certain variable filling height with buffer action, with uniformly trouble free withdrawal of the web, the lower arc exit can have a substantially vertical section.

Since the individual folded layers, lying on top of each other, have a tendency to slip, it is advisable to arrange a support device for the stack of web on the inside of the vertical section. The latter can comprise, for instance, at least one roller rotatable about a transversal axis, which is arranged within the lower arc and the circumference of which adjoins the vertical section.

An alternative comprises forming the support device by a vertical section of the belt arrangement forming the hold down device.

At least in the region of the lower arc, slide rails on which the web of material rests can be installed and arranged parallel to each other in the travel direction.

This allows running webs of different widths without the danger that the web might run irregularly in the transverse direction.

BRIEF DESCRIPTION OF THE DRAWING

The single FIGURE diagrammatically depicts a vertical longitudinal section through apparatus according to the present invention.

DETAILED DESCRIPTION OF THE INVENTION

As illustrated, a web of material 1 is pulled from a stack 2 and passes through an impregnating station 3 to a squeezing mechanism 4. The operating velocity of the impregnating station 3 and the squeezing mechanism 4 is controlled by a compensating roller 5. The web 1 runs from below into the entrance 6 of a housing 7 which contains a storage and transport device designated as a whole with 10. The vertical longitudinal cross section of the storage and transport device is approximately J-shaped with a long leg 8 and a lower arc 9. Above the leg 8 there is a folding or pleating device 11, and at the exit opening of the lower arc 9, there is a withdrawal device 12.

The leg 8 comprises a support plate 13 which is hinged about an axis 14 at its lower end in the vicinity of the transition to the lower arc 9. The tilting is brought about by hydraulic cylinders 15 which, in the illustrated embodiment, engage the upper portion of the support plate 13 and are supported at the housing 7. By suitably actuating the cylinders 15, the angle of inclination 16 of the support plate 13 to the vertical can be adjusted.

The lower arc 9 is formed by a tray 17 which contains a treatment liquid, through which the stack of the web 1 is conducted.

Between the upper edge of the tray 17, forming the start of the lower arc 9, and the support plate 13, a passage 19 is provided through which an endless belt arrangement 20, which advances in a direction corresponding to the feed direction of the web, runs from the outside into the interior of the arc 9. Belt arrangement 20 traverses the arc between the web 1 and the bottom of the tray 17. In the illustrated embodiment, the belt arrangement 20 consists of a screen belt which is driven in a controlled manner so as to ensure the transport of the stacked web of material 1 through the lower arc 9, in conjunction with the component of force resulting from the height different 21 between the inlet and the outlet of the device 10.

In order to prevent the layers 22 of the web 1 from floating up, a hold down device 23 is disposed in the lower arc 9 region at a distance above the bottom of the tray 17 or above the belt arrangement 20; in the illustrated embodiment, it consists of three rollers 24 which are adjacent to each other in the feed direction of the web 1 and rotate about transversal axis. However, a revolving endless belt arrangement 26 which extends across the width of the web and the shape of which fits the bottom of the arc 9 in the region facing the bottom of the tray 17, can also be provided instead of the rollers 24. The speed of the rollers 24 or the speed of the belt arrangement is adapted to the speed of the belt arrangement 20. The hold down device 23 should have a lower velocity, so that the layers 22 of the web 1, traversing to the upright position from the horizontal position at the entrance of the leg 8 travel neatly into a rotated horizontal position at the exit of the arc 9. At this exit, a vertical section 27 is provided in which the layers of the web 1, lying horizontally on top of each other, are transported upward and to which the outside of the web 1 is fed by the part 28 of the belt arrangement 20, which is vertically at this point. On the inside, the web is fed by two support rollers 29 which are arranged vertically one above the other and which rotate about transversal axes. This positive feeding prevents the web 1 from slipping sideways. The vertical part of the belt arrangement 26 can be used for guiding instead of the rollers 29.

At point 30, the web of material 1 is pulled off the stack of layers 22, then runs through a so-called water trap 31 which forms the exit from the housing 7 and is fed to further treatment after being squeezed out in a squeeze roller mechanism 32.

If no belt arrangement 20 is provided or if the belt arrangement 20 consists of several parallel belts leaving space between them, slide rails 33, which guide the web in the transversal direction, are arranged on the support plate 13 and on the bottom of the tray 17.

What is claimed is:

1. In apparatus for the dwelling treatment of textile webs including: a storage and transport section, the vertical longitudinal cross section of which is approximately J-shaped with a leg and lower arc, the leg of which is inclined, in the travel direction of the web material, at an angle deviating from the vertical; means above the leg for folding the web of material from the top in substantially horizontal layers into the storage and transport section; and means for withdrawing the web disposed above the exit opening of the lower arc, the improvement comprising:

(a) said leg being formed by a support plate; and (b) means for varying the inclination angle of the leg comprising means hinging said support plate about a transversal axis in the vicinity of the transition to the lower arc and a controllable tilting device for adjusting the inclination angle.

2. The improvement according to claim 1 and further including an endless belt arrangement which revolves in the travel direction of the web; and a support arrangement following the shape of the arc for said belt disposed in the lower arc.

3. The improvement according to claim 2, and further including a passage between the support plate and the lower arc through which passage the belt arrangement runs onto the support arrangement from the outside.

4. The improvement according to claim 3 and further including a hold down device, disposed at a distance above the lower arc, co-revolving with said belt arrangement.

5. The improvement according to claim 4, wherein said hold down device runs at a lower speed than said belt arrangement.

6. The improvement according to claim 6 wherein said hold down device comprises at least one roller rotating about a transversal axis.

7. The improvement according to claim 6 wherein said hold down device comprises a belt arrangement which is guided according to the shape of the lower arc.

8. The improvement according to claim 7 wherein said lower arc has a substantially vertical section at its exit.

9. The improvement according to claim 8, and further including a support device for the web stack disposed on the inside of the vertical section.

10. The improvement according to claim 9, wherein said support device comprises at least one roller disposed for rotation about a transversal axis, disposed within the lower arc and adapted to engage the vertical section at its circumference.

11. The improvement according to claim 9, wherein said support device comprises a vertical section of the belt arrangement.

12. The improvement according to claim 1, and further including slide rails disposed in the region of the lower arc, said slide rails arranged parallel side by side in the direction of travel and said web of material resting thereon.

13. In apparatus for the dwelling treatment of textile webs including: a storage and transport section, the vertical longitudinal cross section of which is approximately J-shaped with a leg and lower arc, the leg of which is inclined, in the travel direction of the web material, at an angle deviating from the vertical; means above the leg for holding the web of material from the top in substantially horizontal layers into the storage and transport section; and means for withdrawing the web disposed above the exit opening of the lower arc, the improvement comprising:

(a) means for varying the inclination angle of the legs; and (b) slide rails disposed in the region of the lower arc, said slide rails arranged parallel side-by-side in the direction of travel of said web of material resting thereon.

* * * * *

UNITED STATES PATENT AND TRADEMARK OFFICE

CERTIFICATE OF CORRECTION

PATENT NO. : 4 196 832

DATED : April 8, 1980

INVENTOR(S) : EDUARD KUSTERS ET AL

It is certified that error appears in the above-identified patent and that said Letters Patent are hereby corrected as shown below:

Column 4, lines 34 and 37, delete "...according to claim 6..." and substitute --...according to claim 4...-- in both occurrences.

Signed and Sealed this

*Seventeenth* Day of *February 1981*

[SEAL]

*Attest:*

RENE D. TEGTMEYER

*Attesting Officer*

*Acting Commissioner of Patents and Trademarks*